United States Patent [19]

Stanley

[11] 4,118,534

[45] Oct. 3, 1978

[54] CRIMPED BICOMPONENT-FILAMENT YARN WITH RANDOMLY REVERSING HELICAL FILAMENT TWIST

[75] Inventor: Harry Eugene Stanley, West Chester, Pa.

[73] Assignee: E. I. Du Pont de Nemours and Company, Wilmington, Del.

[21] Appl. No.: 795,915

[22] Filed: May 11, 1977

[51] Int. Cl.[2] ..... D02G 3/00

[52] U.S. Cl. ..... 428/370; 428/371; 428/373; 428/374; 428/397

[58] Field of Search ..... 428/370, 373, 374, 397, 428/369, 371; 264/171; 57/140 BY

[56] References Cited

U.S. PATENT DOCUMENTS

| | | | |
|---|---|---|---|
| 3,117,906 | 1/1964 | Tanner | 428/374 |
| 3,917,784 | 11/1975 | Nishida | 264/103 |
| 4,002,795 | 1/1977 | Barbe | 428/370 |

*Primary Examiner*—Marion E. McCamish

[57] ABSTRACT

Crimped bicomponent-filament yarn is produced by spinning composite filaments of polyhexamethyleneadipamide and polyethylene terephthalate modified with 5-(sodium sulfo) isophthalate, with the two components side by side in oblong filament cross sections wherein the length of the major axis is 2.5 to 4.5 times the length of the minor axis and the polyhexamethyleneadipamide component occupies 20 to 35 percent of the total cross-sectional area, drawing the filaments about 3× in about 200° C steam, and crimping the filaments in a bulking jet with air or steam at about 280° C. The composite filaments have a randomly reversing filament twist with an average of 60 to 120 crimps per inch (23.5 to 47 crimps/cm) of filament and, when the yarn is heated at about 100° C in aqueous caustic solution, filament components split apart to form a yarn having crimped copolyester filaments surrounded by arched filaments of polyhexamethyleneadipamide.

6 Claims, 5 Drawing Figures

CRIMPED BICOMPONENT-FILAMENT YARN WITH RANDOMLY REVERSING HELICAL FILAMENT TWIST

BACKGROUND OF THE INVENTION

This invention relates to multifilament yarn of crimped bicomponent filaments and to a process for preparing it. The invention is more particularly concerned with yarn of crimped filaments composed of side-by-side polymeric components which will split apart in fabric finishing operations to provide improved fabric properties.

Bulky yarn has been prepared by melt-spinning two synthetic polymers to form a yarn of bicomponent filaments wherein the two components have different shrinkage properties, drawing and then heat relaxing the filaments to form a yarn of crimped filaments. For most purposes this product does not have sufficient advantages over conventional textured yarn of monocomponent filaments to justify the expense of producing bicomponent filaments. Breen et al. U.S. Pat. No. 3,017,686 discloses, in Example I and FIGS. 11 and 13, bicomponent filaments having a central portion of polyethylene terephthalate and two fins of polyhexamethyleneadipamide. The cross section of each fin has a width to thickness ratio of about 7 to 1, and the fin is lapped over the polyethylene terephthalate central component to give additional adhesive strength, as shown in FIG. 13 of the patent. When heat relaxed in boiling water, the central portion shrinks more than the fins and causes the fins to convolute helically about the central portion to give about 30 ruffles per inch of the type shown in FIG. 11.

Tanner U.S. Pat. No. 3,117,906 (or No. 3,181,224) discloses bicomponent filaments having rounded cross-sectional contours wherein a polyethylene terephthalate component and a polyhexamethyleneadipamide component are in temporary adhering side-by-side relationship along the length of the filament. As illustrated in Example I, when fabric containing the filaments is scoured at about 100° C. while being vigorously flexed, the two components split apart as shown in FIG. 5. After drying and heat-setting at 400° F. (204° C.), the filaments are crimped as shown in FIG. 6. The crimp is of low order. Similar disclosure is found in Breen U.S. Pat. No. 3,117,362.

Nishida U.S. Pat. No. 3,917,784 also discloses bicomponent filaments having rounded cross-sectional contours wherein one component is polyethylene terephthalate and the other component is polyhexamethyleneadipamide. As the filaments are melt-spun, a non-aqueous oil composition is applied prior to the conventional aqueous spin finish to protect the filaments from splitting prematurely. After drawing, the filaments are permitted to relax in ambient air to develop spontaneous crimp. The filaments are split by immersing them in water at a temperature lower than 50° C. and then raising the temperature higher than 80° C. Loss of spontaneous crimp during the latter step can be avoided by packing the filaments in a vessel during treatment or, alternatively, the filaments may be used in fabric, then heat set and thereafter treated to split the components.

SUMMARY OF THE INVENTION

The present invention is a crimped bicomponent-filament yarn of filaments having a polyhexamethyleneadipamide component and a copolyester component adhered together in a side-by-side composite filament of oblong cross section along the length of the filament. The length of the major axis of the cross section is between 2.5 and 4.5 times (preferably about 2.7 to 3.1 times) the length of the minor axis. The polyhexamethyleneadipamide component occupies an area at one side of the cross section that extends along the major axis for a distance about equal to the length of the minor axis and is between 20 and 35 percent (preferably about 28 to 32 percent) of the total cross-sectional area of the filament. The two components of the filament are preferably adhered together at an interface perpendicular to the major axis of the filament cross section.

The copolyester component consists essentially of poly[ethylene terephthalate/5-(sodium sulfo)isophthalate] containing 0.5 to 3 mole percent (preferably about 1 to 2 mole percent) of the 5-(sodium sulfo)isophthalate units. The polyhexamethyleneadipamide preferably contains about 0.4 percent by weight of aminopropylmorpholine and about 0.1 percent by weignt of bis-hexamethylenetriamine.

The bicomponent filaments have a randomly reversing filament twist with an average of 60 to 120 crimps per inch of filaments, (23.5 to 47 crimps/cm) and have the property of splitting into polyhexamethyleneadipamide filaments and copolyester filaments when heated at about 100° C. in 1 percent aqueous caustic solution. Preferably the yarn comprises at least 17 bicomponent filaments that split to form a yarn having helically crimped copolyester filaments surrounded by less highly crimped, arched filaments of polyhexamethyleneadipamide.

DETAILED DESCRIPTION

The bicomponent filaments are produced by melt-spinning polyhexamethyleneadipamide and poly[ethylene terephthalate/5-(sodium sulfo)isophthalate] side by side through each of a plurality of slit-shaped spinneret orifices. Spinneret arrangements of the type disclosed in Breen U.S. Pat. No. 3,117,362 are used to feed the two polymers to the orifices. The rate of feed and orifice dimensions are adjusted to produce composite filaments of oblong cross section along the length of the filament with the polyhexamethylene adipamide occupying between 20 and 35 percent of the total cross-sectional area. The length of the major axis of the cross section should be between 2.5 and 4.5 times the length of the minor axis, and the polyhexamethyleneadipamide component should occupy an area at one side of the cross section that extends along the major axis of the cross section for a distance about equal to the length of the minor axis.

Figure 1:
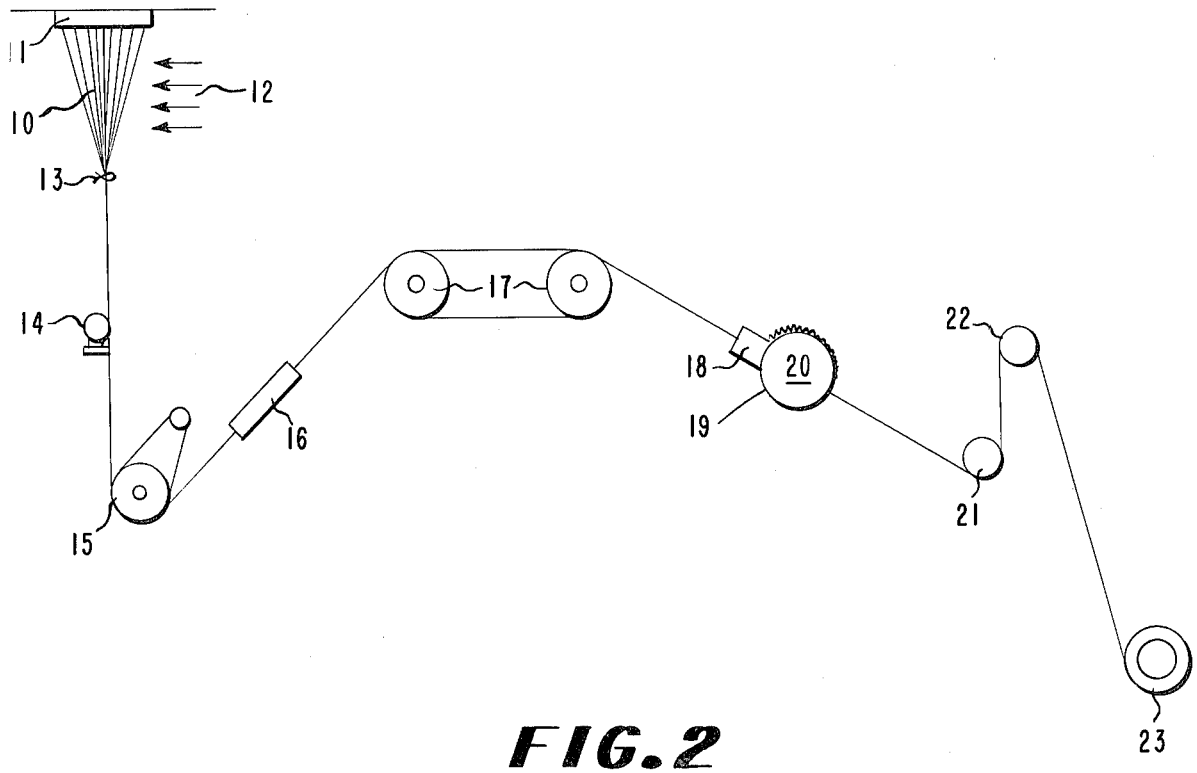
FIG. 1 is a schematic representation of a preferred process for making the crimped bicomponent-filament yarn of this invention.

As shown in FIG. 1, filaments 10 are melt-spun from spinneret 11, are quenched by a cross-flow of cooling air 12 and are gathered into a yarn bundle by passage through guide 13. Aqueous spin finish is applied to the yarn by finish roll 14 and the yarn passes around feed roll 15, through a steam draw jet 16, and is drawn at a draw ratio of about 3× to 3.5× by draw rolls 17. The yarn is drawn at a temperature of about 200°–220° C. The drawn yarn is fed directly into a hot jetted stream of turbulent steam or hot air in bulking jet device 18, which crimps the yarn filaments and deposits them on the surface 19 of a rotating screen drum 20 revolving at much slower linear speed than the yarn feed rate to the jet device. A bulking jet device of the type disclosed in Coon U.S. Pat. No. 3,525,134, supplied with steam or air at about 270°–280° C. and about 65–80 psig (4.4–5.5 atmospheres), is suitable for crimping the yarn filaments. The yarn relaxes and cools on the screen drum, is taken off around roll 21, is tensioned sufficiently to remove filament entanglement by passage over roll 22, and is wound up on package 23.

Figure 2:
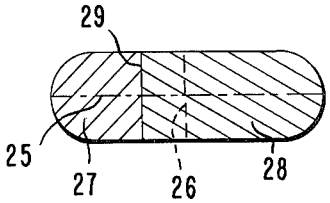
FIG. 2 is a greatly enlarged cross-sectonal view of one of the bicomponent filaments.

FIG. 2 illustrates a filament cross section of a filament of this invention. The length of the major axis 25 is between 2.5 and 4.5 times the length of the minor axis 26 of the cross section. The area 27 is occupied by the lower shrinkage polyhexamethyleneadipamide component and the area 28 is occupied by the higher shrinkage poly[ethylene terephthalate/5-(sodium sulfo)isophthalate] component. The two components are adhered together at interface 29, which is preferably about perpendicular to major axis 25.

Figure 3:
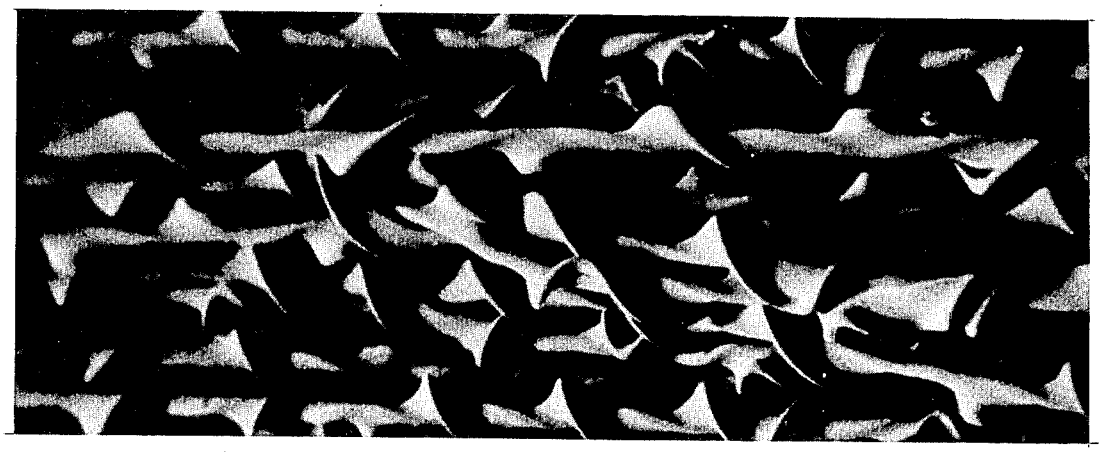
FIG. 3 is a photomicrograph of a crimped bicomponent-filament yarn as viewed perpendicular to the yarn length.

FIG. 3 is a photomicrograph of a crimped bicomponent yarn of this invention, shown under sufficient tension to straighten the copolyester component of the filaments. The higher shrinkage which the copolyester has undergone in the hot jetted stream causes the lower shrinkage polyhexamethyleneadipamide component to spiral around the copolyester component in a randomly reversing helical twist.

Figure 4:
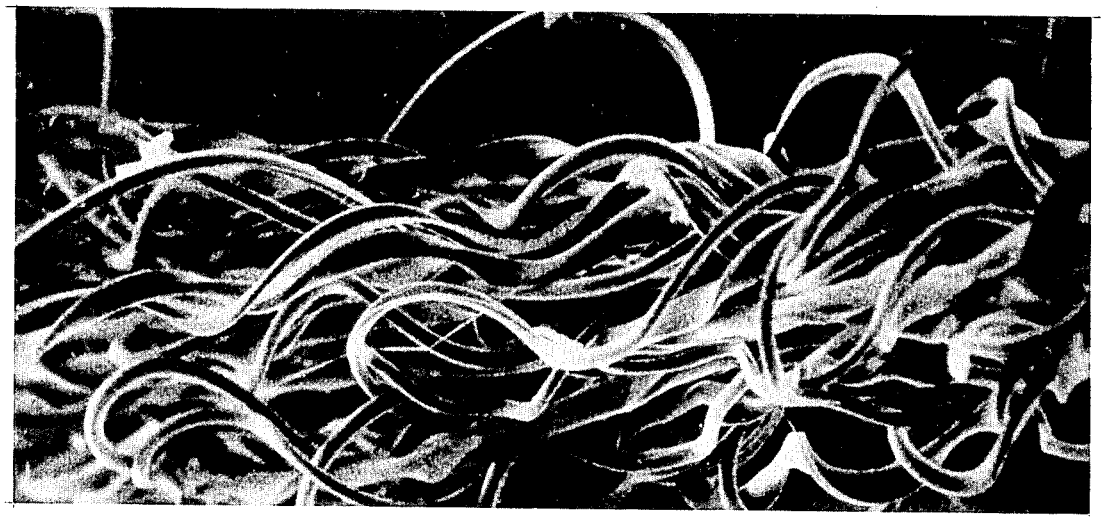
FIG. 4 is a similar photomicrograph showing the appearance of a yarn after the filament components have been split apart.

FIG. 4 is a photomicrograph of the relaxed yarn after it has been heated at about 100° C. in 1 percent aqueous caustic solution. The two filament components have split apart to form twice as many filaments. The wider copolyester filaments are randomly disposed in the filament bundle and are crimped in a randomly reversing helical spiral. The narrower polyhexamethyleneadipamide filaments have a random three-dimensional curvilinear crimp and form arch-like loops on the yarn surface.

Figure 5:
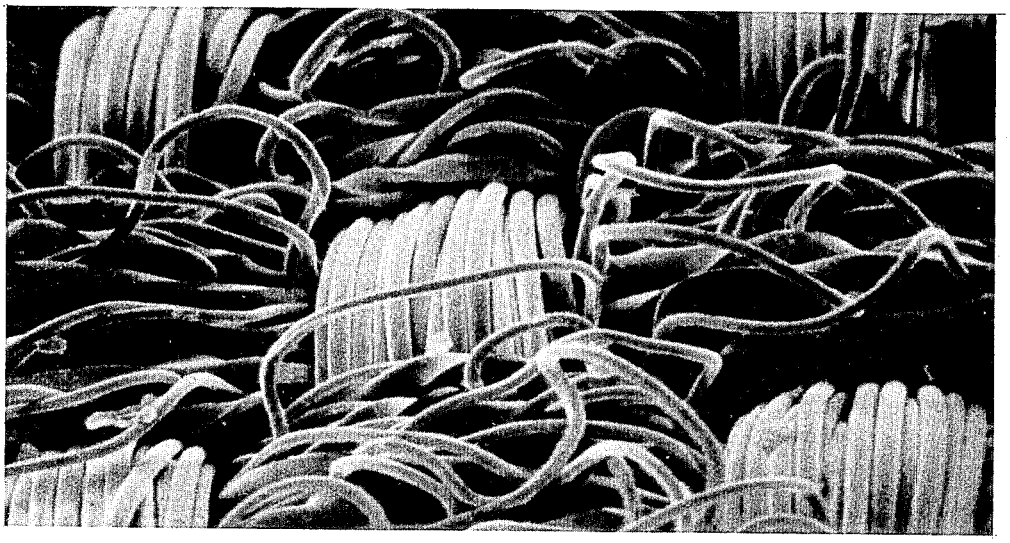
FIG. 5 is a photomicrograph of a fabric woven with warp yarn of uncrimped homogeneous filaments and filling yarn of crimped bicomponent filaments of this invention, showing the components split apart after scouring the fabric in 1 percent aqueous caustic solution at a temperature near the boiling point.

FIG. 5 is a photomicrograph of a plain weave fabric in which there are 100 warp yarns per inch and 80 filling yarns per inch. The warp yarns are of uncrimped 70 denier polyester yarn composed of 34 filaments of round cross section. The filling yarn used in weaving the fabric is 70 denier, 17 filament, crimped bicomponent filament yarn of this invention. FIG. 5 shows the fabric after it has been scoured in 1 percent aqueous caustic solution at a temperature near the boiling point. The two components of the bicomponent filaments have split apart to form copolyester filaments and polyhexamethyleneadipamide filaments. The wider copolyester filaments are of shorter length and follow the most direct path over and under the warp yarns. The narrower polyhexamethyleneadipamide filaments form arch-like loops on the fabric surface. The crimp and entanglement of the filaments limit the extent to which these loops protrude from the surface of the fabric, resulting in a dryer hand and less slippery feel than would be the case if the filaments protruded a longer distance with a large bending radius. The feel of the surface is not the slick cold feel normally associated with nylon; it closely resembles the dry hand of wool.

Prior to splitting the components the bicomponent filaments are all of the same length and are equally load-bearing when formed into fabric, so stripping back of longer filaments cannot occur. When the fabric is formed and the components are split apart, the longer polyhexamethyleneadipamide filaments provide a substantially uniform layer over the surface of the fabric, without any bunching.

Polyhexamethyleneadipamide has an acceptance for dyes which is different from that of the copolyester component. It is possible to dye the two components differently in a bath of mixed dyes to provide a pleasing optical effect. The color of the polyhexamethyleneadipamide filament layer on the surface of the fabric predominates when the fabric is viewed at a glancing angle. However, when the fabric is viewed perpendicularly the color of the copolyester filaments predominates because of their larger mass. This characteristic will be referred to as "haloing" or a "halo" effect.

The combination of filament components, filament cross-sectional configuration, drawing conditions and bulking conditions specified provide bicomponent filaments which will resist splitting apart until processed into fabric but which will then split into polyhexamethyleneadipamide filaments and copolyester filaments during a normal fabric scour. Stronger adhesion between the filament components can be provided by increasing the interface between the components, e.g., by an interface at 45° angle to the major axis of the cross section instead of perpendicular, but splitting the two components apart may then be too difficult. It has been found that a better solution is to use a polyhexamethyleneadipamide component which contains about 0.4 percent by weight of aminopropylmorpholine and about 0.1 percent by weight of bis-hexamethylenetriamine.

The process steps of melt-spinning, drawing and bulking are preferably carried out in a coupled continuous operation, but can be split in various ways. The yarn can be spun and wound up in an independent step, but difficulty will be encountered with unwinding the package unless the yarn is steamed, and steaming before drawing interferes with obtaining desirable filament crimp. The yarn can be spun, drawn and wound up before it is bulked, but the desired bulking effect will become difficult to obtain if the unbulked yarn is allowed to age before bulking.

EXAMPLE 1

Crimped bicomponent-filament yarn is produced by melt-spinning composite filaments at 1000 yards per minutes (915 m/minute), applying an aqueous spin-finish to the filaments, drawing the filaments at 3.0× draw ratio, bulking the filaments and winding up the filaments as a yarn at 1990 yards per mintue (1820 m/minute) in a continuous coupled process as disclosed in the detailed description of FIG. 1. About 70 percent of the volume of each filament is poly[ethylene terephthalate/5-(sodium sulfo)isophthalate] containing 1 percent of the 5-(sodium sulfo)isophthalate units and the remainder of each filament is polyhexamethyleneadimpamide containing 0.42 percent by weight of aminopropylmorpholine and 0.12 percent by weight of bis-hexamethylenetriamine. The filaments have an oblong cross section with the length of the major axis 2.8 times the length of the minor axis of the cross section. The two components are adhered together at an interface which is about perpendicular to the major axis as shown in FIG. 2.

The melt-spun filaments are cooled with cross-flow air at about ambient temperature. The filaments pass over a feed roll at 1000 yards per minute (915 m/minute) and are drawn at a draw roll speed of 3000 yards per minute (2740 m/minute). The draw point is localized with a steam jet supplied with steam at 200° C. and 70 pounds per square inch gage pressure (4.75 atmospheres). The drawn filaments pass directly into a bulking jet supplied with steam at 280° C. and 65 psig (4.4 atmospheres), and are impinged on a screen drum having a surface speed of 260 yards per minute (238 m/minute). The filaments are taken off the screen drum and wound up at 1990 yards per minute (1820 m/minute) under a tension of 11–12 grams. Properties of the bulked yarn are given in the table.

The yarn is knitted into a fabric of jersey construction. The fabric is scoured for 15 minutes in 1 percent aqueous caustic solution heated near the boiling point. The two components of the filaments split apart and a layer of low crimp frequency polyhexamethyleneadipamide filaments blooms above a surface composed largely of tightly crimped (low amplitude) copolyester filaments. The fabric is dyed with both acid and cationic dyes. The filaments dye to different colors to provide a distinct "layering" effect in which the acid dye color of the poly(hexamethyleneadipamide) filaments halos the cationic dye color of the copolyester filaments.

EXAMPLE 2

Example 1 is repeated except that the aminopropylmorpholine and bis-hexamethylenetriamine are omitted from the poly(hexamethyleneadipamide) component. Properties of the bulked yarn are given in the table. The knit, scoured and dyed fabric has a slightly reduce "layering" effect which appears to be related to greater crimp in the poly (hexamethyleneadipamide) filaments.

EXAMPLE 3

Unbulked bicomponent-filament yarn is produced by melt-spinning composite filaments, applying an aqueous spin-finish to the filaments, drawing the filaments at 3.3× draw ratio and winding up the filaments as a yarn at 3000 yards per minute (2740 m/minute), as disclosed in the detailed description of FIG. 1, but by-passing the bulking step. About 70 percent of the volume of each filament is poly[ethyleneterephthalate/5-(sodium sulfo)isophthalate] containing 1 percent of the 5-(sodium sulfo)isophthalate units and the remainder of each filament is polyhexamethyleneadipamide containing 0.42 percent by weight of aminopropylmorpholine and 0.12 percent by weight of bis-hexamethylenetriamine. The filaments have an oblong cross section with the length of the major axis 2.9 times the length of the minor axis of the cross section. The two components are adhered together at an interface which is about perpendicular to the major axis. The melt-spun filaments are cooled with cross-flow air at about ambient temperature. During drawing the draw point is localized with a steam jet supplied with steam at 220° C. and 80 psig (5.45 atmospheres).

The above yarn is subsequently bulked by feeding it at 600 yards per mintue (548 m/minute) to a bulking jet supplied with steam at 270° C. and 80 psig (5.45 atmospheres) which impinges the yarn onto the surface of a screen drum having a surface speed of 167 yards per minute (152 m/minute). The relaxed, bulked yarn is taken off the drum and wound up at 403 yards per minute (368 m/minute) under 12–13 grams tension. Properties of the bulked yarn are given in the table.

When knit into fabric, scoured in 1 percent aqueous caustic solution heated near the boiling point, and dyed with both acid and cationic dyes, the fabric exhibits a distinct "layering" effect.

EXAMPLE 4

Example 3 is repeated except that the aminopropylmorpholine and bis-hexamethylenetriamine are omitted from the poly(hexamethyleneadipamide) component. Properties of the bulked yarn are given in the table. Some filaments split during the bulking operation and the resulting loopy yarn is difficult to knit. However, the knit, caustic scoured and dyed fabric exhibits good "layering" effect with accompanying halo dyeing and soft hand.

EXAMPLE 5

Example 3 is repeated except that the copolyester component contains 2 percent of the 5-(sodium sulfo)isophthalate units and a greater number of filaments are spun. Properties of the bulked yarn are given in the table. The performance of the bulked yarn in fabric compares favorably with that of Example 3.

EXAMPLE 6

Example 5 is repeated except that only one-half as many filaments are spun and the bulked yarn is wound up at 417 yards per minute (381 m/minute) and 6 grams tension. Properties of the bulked yarn are given in the table. The performance of the bulked yarn in fabric compares favorably with that of Example 3.

EXAMPLE A (comparison)

Example 3 is repeated except that the 5-(sodium sulfo)isophthalate is omitted from the polyester component. The 100 denier unbulked yarn has a tenacity of 2.8 gpd, and elongation to break of 42%, and an initial modulus of 69 gpd. Attempts to bulk this yarn under the conditions of Example 3 are unsuccessful. Bulking is accomplished at higher temperature and pressure but the filaments are extensively split during the bulking operation. In fabrics this yarn gives heather dyeing instead of halo dyeing, and the high amplitude of crimp obtained in the polyester filaments results in a harsher hand than that of Example 3.

The values for crimp frequency given in the following table are determined by counting the number of crimps between two points on a filament and dividing by the length of filament when under just enough tension to straighten it without stretching it. The other values are determined in conventional manner.

TABLE

| | Properties of Bulked Yarns | | | | | |
|---|---|---|---|---|---|---|
| Example No. | 1 | 2 | 3 | 4 | 5 | 6 |
| Yarn denier | 156 | 155 | 151 | 149 | 154 | 72 |
| No. filaments | 17 | 17 | 17 | 17 | 34 | 17 |
| Tenacity(gpd) | 1.5 | 1.4 | 1.8 | 1.7 | 1.5 | 1.8 |

TABLE-continued

| Example No. | Properties of Bulked Yarns 1 | 2 | 3 | 4 | 5 | 6 |
|---|---|---|---|---|---|---|
| Break elongation(%) | 96 | 93 | 113 | 100 | 80 | 88 |
| Init. modulus(gpd) | 13 | | 12 | | 9 | 12 |
| Yield Point(gpd) | 0.36 | 0.36 | 0.34 | 0.38 | 0.30 | 0.34 |
| Crimp Frequency | | | | | | |
| (crimps/inch) | 94 | | 82 | 78 | 63 | 107 |
| (crimps/cm) | 37 | | 32 | 31 | 25 | 42 |

I claim:

1. A crimped bicomponent-filament yarn comprising fliaments having a polyhexamethyleneadipamide component and a copolyester component adhered together in a side-by-side composite filament of oblong cross section along the length of the filament wherein the length of the major axis of the cross section is between 2.5 and 4.5 times the length of the minor axis, the polyhexamethyleneadipamide component occupies an area at one side of the cross section that extends along said major axis for a distance about equal to the length of said minor axis and is between 20 and 35 percent of the total cross-sectional area; said copolyester component consisting essentially of poly[ethylene terephthalate/5-(sodium sulfo)isophthalate] containing 0.5 to 3 mole percent of the 5-(sodium sulfo)isophthalate units; the bicomponent filaments having a randomly reversing filament twist with an average of 60 to 120 crimps per inch of filament and having the property of splitting into polyhexamethyleneadipamide filaments and copolyester filaments when heated at about 100° C. in 1 percent aqueous caustic solution.

2. A bicomponent-filament yarn as defined in claim 1 wherein the two components of the filament are adhered together at an interface perpendicular to the major axis of the filament cross section.

3. A bicomponent-filament yarn as defined in claim 2 wherein the polyhexamethyleneadipamide component contains about 0.4 percent by weight of aminopropylmorpholine and about 0.1 percent by weight of bis-hexamethylenetriamine.

4. A bicomponent-filament yarn as defined in claim 1 wherein the length of the major axis of the filament cross section is about 2.7 to 3.1 times the length of the minor axis and the polyhexamethyleneadipamide component occupies about 28 to 32 percent of the cross-sectional area of the filament.

5. A bicomponent-filament yarn as defined in claim 1 wherein the copolyester component contains about 1 to 2 mole percent of the 5-(sodium sulfo)isophthalate units.

6. A bicomponent-filament yarn as defined in claim 1 comprising at least 17 filaments that split when heated at about 100° C. in 1 percent aqueous caustic solution and form a yarn of helically crimped copolyester filaments surrounded by less highly crimped, arched filaments of polyhexamethyleneadipamide.

* * * * *